US008161716B2

(12) United States Patent
Hibi et al.

(10) Patent No.: US 8,161,716 B2
(45) Date of Patent: Apr. 24, 2012

(54) METHOD OF PACKAGING A COMPRESSED FILTER TOW BALE

(75) Inventors: Takashi Hibi, Himeji (JP); Hirofumi Tsujita, Himeji (JP)

(73) Assignee: Daicel Chemical Industries, Ltd., Osaka (JP)

( * ) Notice: Subject to any disclaimer, the term of this patent is extended or adjusted under 35 U.S.C. 154(b) by 114 days.

(21) Appl. No.: 12/750,257

(22) Filed: Mar. 30, 2010

(65) Prior Publication Data

US 2011/0023898 A1 Feb. 3, 2011

(30) Foreign Application Priority Data

Mar. 31, 2009 (JP) ..... 2009-85630
Feb. 19, 2010 (JP) ..... 2010-34193

(51) Int. Cl.
*B65B 1/24* (2006.01)

(52) U.S. Cl. ..... 53/436; 53/527

(58) Field of Classification Search ..... 53/436, 53/527, 121, 523, 529, 209
See application file for complete search history.

(56) References Cited

U.S. PATENT DOCUMENTS

| | | | | |
|---|---|---|---|---|
| 3,099,952 | A * | 8/1963 | Dixon et al. | 100/3 |
| 3,252,737 | A * | 5/1966 | Seaton | 297/462 |
| 4,157,754 | A | 6/1979 | Bartsch et al. | |
| 4,162,603 | A | 7/1979 | Stromberg | |
| 4,942,719 | A | 7/1990 | Fleissner | |
| 5,369,935 | A | 12/1994 | Lang et al. | |
| 5,572,854 | A | 11/1996 | Greiner et al. | |
| 5,623,811 | A * | 4/1997 | Hirschek et al. | 53/436 |
| 5,775,058 | A | 7/1998 | Hirschek | |
| 6,098,378 | A * | 8/2000 | Wyatt | 53/430 |
| 6,293,075 | B1 * | 9/2001 | O'Connor et al. | 53/429 |
| 6,708,465 | B1 * | 3/2004 | Gustafsson | 53/463 |
| 6,922,978 | B2 * | 8/2005 | Gualchierani | 53/529 |
| 2005/0161358 | A1 | 7/2005 | Kern | |
| 2006/0243142 | A1 | 11/2006 | Mullins et al. | |

FOREIGN PATENT DOCUMENTS

| | | | |
|---|---|---|---|
| CA | 2 482 107 | C | 10/2003 |
| EP | 0248576 | A1 | 12/1987 |
| GB | 1156860 | A | 7/1969 |
| GB | 1 280 932 | A | 7/1972 |
| JP | 53-87890 | A | 8/1978 |
| JP | 53-143491 | | 12/1978 |
| JP | 7-215338 | A | 8/1995 |
| JP | 9-508880 | A | 9/1997 |
| JP | 2001-206322 | A | 7/2001 |
| JP | 2005-528096 | A | 9/2005 |
| JP | 2006-517896 | A | 8/2006 |
| WO | WO 95-22490 | A1 | 8/1995 |
| WO | WO 02/32238 | A2 | 4/2002 |
| WO | WO 03/089309 | A2 | 10/2003 |
| WO | WO 2004/074134 | A1 | 9/2004 |

* cited by examiner

*Primary Examiner* — Sameh H. Tawfik
(74) *Attorney, Agent, or Firm* — Birch, Stewart, Kolasch & Birch, LLP

(57) ABSTRACT

A packaging method for a filter tow bale includes, including excessively compressing a distance between press bases to a height lower than a desired height of a packaged bale by 50 to 250 mm, more preferably 80 to 200 mm, further preferably 90 to 180 mm, then adjusting the distance between the press bases to the desired height in a packaged or non-packaged state, and then releasing a pressing force applied on a pressed bale.

8 Claims, 7 Drawing Sheets

METHOD OF PACKAGING A COMPRESSED FILTER TOW BALE

BACKGROUND OF THE INVENTION

1. Field of the Invention

The present invention relates to a packing method for a compressed package of filter tow or filament, and more particularly to a method of packing tow for cigarette filters. Further, the present invention relates to a packing method for a package obtained by packing compressed filament or the like with a bonding method such as sealing.

In particular, the present invention relates to, a packing method for a package obtained by packing filter tow made of cellulose acetate, the content of which is compressed with pressing means such as a press, including decreasing rebound internal pressure caused by the compression of the content and then making an entire peripheral seal, dot seal, bonding or the like to control the rebound force.

2. Description of the Related Art

Fiber, tow, filament and the like have a low bulk density. Filter tow made of cellulose acetate, for example, has a low bulk density of approximately 100 kg/m$^3$. Considering transport efficiency and in-house handling during processing into a cigarette filter, filament is compressed with pressing means, such as a press, to increase the bulk density to 300 to 600 kg/m$^3$ at the time of packing. This type of package is referred to as bale (tow bale).

A packaging method and a packaging device for filter tow bales are described in WO-A2 02/32238 as a bale compressing device (bale packing device). According to the technology described in this document, a manufactured filter tow is in a form of a continuous fiber. That is, it is advantageous in terms of production efficiency to use a long filter tow for processing into a filter because a manufacturing device for a cigarette filter operates at a high speed of 400 to 600 m/min. Thus, the length of the filter tow needs to be long as described above. In the case of usual monofilament having a diameter of 3 D (denier, applied hereinafter), a tow band of integrated tow filaments includes 10000 to 13000 monofilaments aligned. Therefore, the filament and the tow band of the integrated filaments have a length of 15 km in the case of a tow band of 30000 D and a tow bale weight of 500 kg, for example. In the bale-packing and bale-compressing device described in the above-mentioned WO-A2 02/32238, a tow band having this length is fed into a so-called filling container (also referred to as a filling box or a compression box). In this state, the filter tow in the filling container is extremely bulky.

Therefore, the filling box has a height as high as 6 m, for example. It is naturally extremely inefficient to transport or store such box, and hence it is required that the filter tow fed into this filling box be compressed to a size suitable for transportation and storage in a common technology. Thus, in a common technology, in the subsequent process, the content filled in the filling container is pressurized vertically and compressed. The compression force is extremely large and is a pressure of several hundred tons, approximately 300 to 600 t in general, and 500 t for example. After this compression, in a state under the compression stress, the compressed filter tow is packed with a packaging material (which may be referred to as a packing material). These packaging materials include a cardboard, a corrugated cardboard, a non-woven cloth, a plastic film, a film include in synthetic fiber and the like. These packaging materials cover the respective surfaces of the compressed filter tow. These packaging materials use a package form in which the tow bale is strapped with straps made of steel or plastic (these are referred to as binding straps) so as not to rupture by the rebound force of the filter tow bale when the pressure applied onto the compressed filter tow is removed. That is, the remaining rebound internal pressure of the filter tow is held by the binding straps.

As described above, a press compression pressure of a highly compressed bale can reach 5000 kPa (500 t/m$^2$) at the maximum and is not lower than 1000 kPa (100 t/m$^2$) even if the compression pressure is low.

Therefore, as described above, even after the packing, a reboundpressure (expansion force of bale) of 20 to 400 kPa remains in the package of the filter tow due to the stress against the compression. Such a rebound pressure has been conventionally well known. JP-A 53-87890 (Patent Document 1), for example, discloses that "there is an internal pressure of at least 0.2 daN/cm$^2$ (20 kPa), and there is a considerably high pressure of up to approximately 3.3 daN/cm$^2$ (330 kPa) in a short time" (page 2, lower right column, line 20 to page 3, upper left column, line 1).

In order to make a package that can withstand such a rebound internal pressure, in prior arts, filter tow package is strapped by a binding strap made of a metal or a plastic strap as described above. The binding strap integrates the packaging material and the pressed bale. In prior arts, packaging materials for the side part, the top and the bottom of a usual package are integrated by a binding strap. As a result, the tow bale is prevented from being ruptured, but portions other than the portion of the binding strap which cannot be expanded will be expanded with expansion of the tow bale.

As a result, the binding strap bites into a surface layer of the filter tow and causes constriction in the tow bale. When the filter tow is taken out as a continuous fiber, the filter tow substantially attaches to itself in that portion, and when the attached portion is pulled, it is likely that the filter tow band is fractured because the filter tow is partially compressed by a high pressure in the constriction portion. Further, it is possible that the binding strap is cut off when unpacked, cut-off pieces of the binding strap are sprung away and a worker might be injured.

Therefore, it has been studied to omit the binding strap in packaging. The above-mentioned Patent Document 1, for example, discloses in order to solve the problem of the filter tow strapping with the strap, a package obtained by packaging a compressed filter tow by a packaging material and bonding the packaging material with an adhesive applied to the packaging material. In this case, the rebound pressure of the tow bale is applied to the packaging material.

Thus, according to the above-mentioned Patent Document 1, the package is described such that the compressed filter tow is wrapped inside with a laminate of aluminum-deposited PP and paper and outside with a corrugated cardboard bonded with a solvent type adhesive, specifically a chloroprene rubber solvent-type adhesive.

As described above, with the above-mentioned Patent Document 1, an expansion force of the compressed bale is applied to the package. Thus, in the above-mentioned Patent Document 1, overlapping portions of the exterior package of the package are bonded to each other with an adhesive providing a shear strength of at least 0.39 daN/cm$^2$ (39 kPa) (claims) to the bonded portion. As described above, in the above-mentioned Patent Document 1, the bonding strength of the bonded portion needs to be considerably large, and the packaging material also needs to be a special material which can withstand the expansion pressure of the bale. Thus, as in the embodiment of the above-mentioned Patent Document 1, the packaging material needs to have a multi-layered structure of an interior package made of a complex material of paper, polyolefin resin and aluminum foil and an exterior package made of cardboard.

Further, JP-A 7-215338 (Patent Document 2) discloses a technology of bonding a top part and a central part of a collecting container without an adhesive, but a planar fastener tape. In this technology, several side parts capable of upright standing surrounding an outer periphery of the collecting container and determining a boundary are provided. By means of this side part, the rebound internal pressure can be withstood without a binding strap. That is, a planar fastener is used between the side part and the collecting container on the side of this package, and the planar fastener is pressure-bonded all the time and firmly bonded by the rebound internal pressure of the collecting container. On the other hand, the side part is required to have rigidity and strength that can withstand the rebound internal pressure of the collecting container, elaborate packing is required, and a cost is raised. Thus, these packages cannot be applied for one-way packing and can be used only in a range that these packing materials can be recovered and reused.

JP-A9-508880 (Patent Document 3) discloses a package sealed with a plastic film or sheet. In accordance with the description of Patent Document 3, 3-sheet packaging with 3 sheets for a top part, a bottom part and a body part, respectively, will be described below. That is, in the case of this packaging, a packing form is disclosed in which a packaging material segment provided so as to wrap the side part is drawn out for a required length from a roll of the packaging material, closed at an end portion and welded by surrounding a pressed bale so as to form a tube closed vertically at a bottom part and a top part. And it is described that the binding strap can be omitted with this packing form. After the bale is compressed in this package, the body part is formed by wrapping with a film, and the bottom part and the top part need to be set in a bale compressing device in advance.

Patent Document 3 describes that the packaging materials of the top part and the body part, and the bottom part and the body part, may be heat-sealed on the entire periphery (page 23, lines 2 to 6) or may be dot sealed in a stripe shape or a point shape at the bonded spot. In the case of dot seal, it is described that the seal can be peeled off relatively easily by hand or using an appropriate machine to be released (page 21, lines 27 to 37). And by employing this packaging form, it is described that even after the pressing force applied to the pressed bale is removed, the expanding bale force is withstood and additional reinforcement by a band or a similar tool is not needed (page 19, lines 28 to 32).

With the technology described in Patent Document 3, the bale is expanded after the pressing force is removed, and the expansion force in that case is also applied to the bonded spot. Therefore, the adhesion strength at the bonded spot needs to be raised to such a degree that can withstand the expansion pressure, and there is a possibility that the bonded spot might be released at the time of expansion.

GB-A 1280932 (Patent Document 4) discloses a bale package containing two parts: a relatively deep bag-base part and a relatively shallow bag cap part. The both bags are stocked and supplied to a bale press. The relatively shallow cap part forms a bottom part of the bale, while the relatively deep base part forms a top part and a body part. Into the base part, a bulky tow is pushed in and compressed by a plunger. The bale in which the base part and the cap part are continuously welded (sealed) (sealed on the entire periphery) is disclosed (column 2, lines 14 to 59).

In the above-mentioned Patent Document 4, the bale is expanded after compression, and the relatively shallow cap part (corresponding to the bottom part when packed into the bale) has an upward projection portion formed under the bale compression. That is, the bottom part has a raised bottom. The projection portion of the bottom part is folded back by the expansion force of the bale so as to become a recess portion, and the packing of the bale is finished (FIGS. 8 to 11).

In the case of this technology, the bag-base part needs to be molded in advance. The bag-base part is molded, and hence it cannot be stored in a stacked state, which is inconvenient for storage and transportation.

Moreover, the filter tow is fed into a compression box as a mass of a continuous pre-compressed fiber, but, after the bag-base part is installed in the compression box, there is a problem that the bag-base part may be removed from the installation part due to friction during insertion of the mass of the yarn body in the compression process. When the compression pressure applied onto the bale is removed, the raised bottom portion of the cap part (bottom part) is folded back by the expansion force of the bale so as to become the recess portion (downward projection portion), but during the expansion, a stress is applied to the cap part and the bag-base part, which might cause peeling-off of the seal or non-uniform expansion.

JP-A2005-528096 (Patent Document 5) discloses a technology in which a surface is smoothed by making an internal pressure of a bale negative by using means such as a vacuum pump in the above-mentioned Patent Documents 3 and 4. According to this document, as described in the above-mentioned Patent Documents 3, 4 and 5, a method for controlling expansion of a bale is proposed, the method involving heat-sealing a package (packing material) made of a plastic sheet or film, for example so as to seal the package, generating a negative pressure inside the bale with expansion of the bale, and, as a means of obtaining additional negative pressure, deaerating the inside of the bale so as to balance an atmospheric pressure with the rebound internal pressure of the bale.

That is, as described also in the above-mentioned Patent Document 5, after filter tow in a compressed state is sealed by airtight seal, an external pressure applied to the packed material is released. As a result, the material is expanded under an action of its own resilient recovering force inside of the package. Then, due to increase of a capacity of the package, a negative pressure is generated in the inside of the package. It is described that the package size is preferably selected so that the compressed filter tow cannot expand completely, that is, so that the filter tow inside the packaging material is still compressed to a certain degree inside the package even after its partial expansion. (paragraph [0021] of JP-A 2005-528096, corresponding to paragraph [0035] of US-A 2005/0161358).

As described above, if deaeration is to be performed, it is performed for the purpose of eliminating excess air inside the package in order to prevent full expansion of the compressed filter tow. It is also described that the minimum value of the negative pressure is 0.01 bar (claim 1). 0.01 bar corresponds to 1 kPa and is smaller than the above expansion force (rebound pressure) of the bale of 20 to 400 kPa, and the negative pressure does not have an effect to control the expansion of the bale. Patent Document 5 discloses a packing technology in which the bale is expanded till the stress by expansion of the bale package and the rebound pressure of the bale are balanced, and in this case, too, a large stress is applied to the heat-seal portion of the packaging material, and there is a problem that the seal portion or the like is fractured.

JP-A2006-517896 (Patent Document 6) discloses a tow packing system in which an evacuator is formed in the package having a 3-piece or 2-piece structure. This document discloses a technology for controlling excessive expansion of a bale by creating a large package wrapping around the bale by using two films for a top portion and a bottom portion and heat-sealing the four edges and removing the excess air through the evacuator so as to form an airtight package. In the case of the package form in which the two films are arranged and sealed to sandwich the bale from above and below the bale, the bale can be covered by the packaging material more easily, but a large excess portion is created in the packaging material (film) after packing the bale to increase an air taken-in amount.

Therefore, even with the increase of the internal capacity by natural expansion of the bale, the amount of excess air is larger than that, and generation of the negative pressure cannot be expected. Thus, in order to evacuate the excess air inside the packaging material and to generate the negative pressure, the air needs to be removed by a vacuum pump or the like. The large amount of air to be removed leads to poor working of efficiency. Even if the inside of the bale can be deaerated to the absolute vacuum as in the above-mentioned Patent Document 5, the resulting atmospheric pressure is only 100 kPa, which cannot control expansion of the bale, and there is a problem that the stress is still applied to the packaging material of the bale.

Further, a special packaging material in which an evacuator is installed needs to be prepared, and there is a problem that a cost of the packaging material is high. Moreover, other than the above problems in workability, there arises a problem that the left over portion needs to be stored neatly because a large quantity of film is left over after the packing. If the storage condition of the film excess portion is not satisfactory, the portion can become obstacles in stacking or transportation of the bale, or abrasion of the film excess portion might cause a pin hole, which results in loss of the internal pressure and causes expansion of the bale.

PATENT DOCUMENTS

[Patent Document 1] JP-A 53-87890
[Patent Document 2] JP-A 7-215338
[Patent Document 3] JP-A 9-508880
[Patent Document 4] GB-A 1280932
[Patent Document 5] JP-A 2005-528096
[Patent Document 6] JP-A 2006-517896

SUMMARY OF THE INVENTION

A problem to be solved is that there is no package in which fiber, tow, filament and the like having a low bulk density are compressed and packed so as to have a high rebound internal pressure, a binding strap is not used, no problem of a solvent smell is involved and handling is easy, and that an easy packaging method of obtaining the package is not available.

That is, as the prior-art packing form eliminating a binding strap, an airtight packing method in which the entire periphery is heat-sealed or other similar method has been disclosed, but with this method, the bale is naturally expanded due to the rebound pressure, and a stress is applied to the package. As a result, there is a problem of rupture or the like in the bale package.

Another problem to be solved is that there has been no method that can control the rebound force of the bale so that a problem such as rupture or the like of the bale package is not caused and a quality of finished bale package can be improved.

Moreover, another problem to be solved is that there has been no technology of manufacturing a bale having a fine appearance without an excess portion in the completed bale package while improving workability in packing of the bale.

The inventors have studied the above problems.

For a package having a large rebound internal pressure, such as a compressed package of fiber, tow or filament, a step of decreasing a distance between press bases in compressing until the distance becomes shorter than a height of a desired packaged bale by 50 to 250 mm, more preferably by 80 to 200 mm, even more preferably by 90 to 180 mm; a step of adjusting, after the step of decreasing, the distance between the press bases at a desired height, that is, widening the distance between the upper and lower press bases, in a packaged or non-packaged state; and a step of, at least after a step of packaging in this state, releasing the pressing force applied onto the pressed bale to finish packing of the tow bale are used.

The term "pressed bale" refers to a bale compressed between the press bases.

Further, the term "press base" means a pressurizing portion of a bale compressing device. The press base includes an upper press base and a lower press base. In many cases, the upper press base and the lower press base are both movable, but it is designed so that a movable range may be larger in either of the upper press base or the lower press base.

Hereinafter, compressing until the distance between the press bases becomes shorter than a height of the desired pressed bale is referred to as "excessive compression".

As a result, the expansion pressure of the pressed bale after the pressure release of the press bases is damped and reduced. As a result, it was found out that a tow bale in which the expansion accompanying the release of the pressing force applied onto the pressed bale does not occur or is extremely small can be packed.

That is, the rebound pressure (expansion pressure) of the pressed bale depends on a packing density and the compression pressure. In the case of compression to the packaging density of approximately 666 kg/m$^3$ by a pressure of 300 t, for example, it was found out that, immediately after completion of the compression as shown in FIG. 1, the rebound pressure as high as 970 kPa is presented. Though this rebound pressure is damped with the elapse of time, the rebound pressure is still 600 kPa even after 10 minutes have passed. As described in the above-mentioned Patent Documents 3 and 5, if the pressing force applied onto the pressed bale is released while the rebound pressure remains, the pressed bale is expanded by the rebound pressure and extends the packaging material. Then, the expansion of the bale is stopped in a state where consumption of the rebound force with the extension of the packaging material, damping of the rebound pressure accompanying the expansion of the pressed bale and the pressure from the outside caused by the negative pressure accompanying the expansion of the bale if sealed are balanced.

During this period, a stress by the expansion acts on a bonded portion of the packaging material of the bale. This stress can reach 4000 N/$_{15mm}$ immediately after the packing. Such a shearing force acts on the bonded portion of the packaging material or the packaging material itself. Therefore, firm bonding should be applied to the bonded port ion of the bale package, and even if the technology in the above-mentioned Patent Document 3 is used, a phenomenon such as fracture of the seal portion can be caused. The expansion of the bale cannot be controlled by the negative pressure inside the bale because a differential pressure between the atmospheric pressure and the negative pressure inside the bale is only 100 kPa at the maximum (that is, even in the absolute vacuum state), and the above-mentioned Patent Document 5 actually describes that the bale is expanded (paragraph [0021]).

However, the inventors of the present invention have arrived at the present invention based on the finding that by extending the pressed bale by approximately 50 to 250 mm under pressurization, the rebound pressure of the pressed bale is rapidly damped.

The size of the tow bale is limited by transportation and other factors. Particularly, tow bales for cigarette filters are exported abroad in many cases, and in such cases, the size depends on a standard size of an international container for import/export. Thus, in the embodiment of the present invention, the bale is excessively compressed in advance (hereinafter referred to as excessive compression in some cases) than a desired bale height, and then a distance (height) of the pressed bale is extended by 50 to 250 mm (hereinafter, this length for movement is referred to as "excessive compression distance" in some cases) so that the bale package which can be used for import/export can be obtained. By packing after such excessive compression, the bale is not expanded at a stage in which the pressing force applied onto the pressed bale is released so that the problem of rupture in the bale package can be avoided.

The moving distance of the press base, that is, the excessive compression distance is 50 to 250 mm as described above, more preferably 80 to 200 mm, even more preferably 90 to 180 mm, even more preferably 90 to 150 mm. If the excessive compression moving distance is smaller than 50 mm, the effect of alleviating the rebound pressure of the pressed bale is not sufficient. According to the study by the inventors of the present invention, the damping effect on the rebound pressure is small unless the excessive compression distance of at least 50 mm is ensured, and the pressed bale is further expanded after the packaging is finished. When deaeration of the inside of the compressed bale or the like is performed as an additional auxiliary means of controlling bale expansion, which will be described later, the expansion after the release of the press base pressure applied onto the pressed bale can be controlled even with the moving distance of the press base with an excessive compression distance of 50 mm.

For the purpose of mechanical engineering or physical accuracy, the excessive compression distance, that is, the length of the excessive compression (moving distance of the press base) should be determined by a desired bale height and its rate. That is, for the bale with the height of 500 mm and the bale with the height of 1500 mm, for example, a degree of excessive compression is different even with the same excessive compression distance. In that sense, if expressed as the rate of the bale height to the excessive compression distance, excessive compression of 5 to 20% to the desired bale height is preferred. More preferably it is 8 to 20%, further preferably it is 9 to 18% and still further preferably it is 9 to 15%.

The above excessive compression distance is mainly applied to the bale height of 700 to 1100 mm. That is, it can be selected as the most efficient height for transporting and storing the desired compressed bale. A more preferred bale height is 800 to 1100 mm, and a further preferred bale height is 900 to 1100 mm. Selection can be made appropriately, but from the viewpoint of transport efficiency, the above excessive compression distance is preferably applied to the bale height of 700 to 1100 mm in the present invention.

Moreover, strictly speaking, in the case of a bale with a low bale height, the packing density needs to be increased in order to ensure a bale weight. If the packaging density is increased, the bale rebound force is inevitably increased. Thus, in the case of the bale with a height of 700 mm, for example, the desired excessive compression distance needs to be increased. For example, in the case of the bale with a height of 700 mm, an excessive compression distance of approximately 7% is needed for the desired bale height to withstand the large packing density. Therefore, considering the above, it is industrially more appropriate to express the technical characteristics of the present invention as the excessive compression distance. In general, the lower the bale height is, the more convenient it is for transport and storage, and the packing work is made more difficult by the above-mentioned problem of the packing density.

However, if the controlling means, described above, is not used, the press base moving distance is preferably 90 mm or more. If the press base moving distance exceeds 250 mm, the expansion force of the compressed bale is fully lost. In this sense, the press base moving distance is preferably larger, but that leads to a problem that the packing density is lowered and the bale transport efficiency is deteriorated.

Further, considering the packing work efficiency, the press base moving distance is preferably smaller. Thus, the upper limit of the press base moving distance is 250 mm, preferably 200 mm, more preferably 180 mm, even more preferably 150 mm. Note that, the technical significance of the present invention is to expand the pressed bale in a controlled state under the pressurization of the press base so as to damp or preferably eliminate the rebound pressure of the pressed bale, and the bale with controlled expansion of the pressed bale of the present invention can be also manufactured by moving the press base more than the expansion limit of the pressed bale. The upper limit of the press base moving distance is set because there is no point in making it larger than a relatively large excessive compression distance (equal to the press base moving distance) in a state in which the rebound pressure of the pressed bale is lost in terms of the packaging work efficiency and the effect of the present invention.

Further, a second solution is a process in which after holding for 5 to 15 minutes in a compression state at a height lower than the desired bale height by 50 to 250 mm, the press base distance is adjusted to a desired height, and after the packing is finished at least by the time of this state, the press base pressure is released. That is, the rebound pressure of the pressed bale is damped with the elapse of time when the pressure is held as described above. However, if only the damping effect of the rebound pressure with the elapse of time is expected, it takes more than 10 hours till it is lowered to approximately 100 kPa as shown in FIG. 1. However, in the present invention, by leaving it in the excessively compressed state for 5 to 15 minutes, the rebound force of the pressed bale is damped in logarithmic approximation.

As described above, after being left for 10 minutes, the rebound pressure becomes approximately 600 kPa. In this state, the distance between the press bases is adjusted to the desired bale height. That is, the compression distance of the pressed bale is relaxed and extended by approximately 50 to 250 mm. With this configuration, the rebound pressure of the pressed bale is further damped, and even if the press base moving distance is small, the expansion of the pressed bale can be controlled when the press base pressure is released (the pressing force applied to the pressed bale is eliminated, that is, the pressed bale becomes free to expand by the internal pressure.).

Subsequently, a raising speed for the press base will be described. The raising speed for the press base can be set arbitrarily, and the press base can be raised at a considerably high speed, for example, at a speed of approximately 70 mm/sec. The press base is raised at a speed of preferably 1 to 100 mm/sec, more preferably at 5 to 90 mm/sec, even more preferably 10 to 50 mm/sec, even more preferably 10 to 30 mm/sec. If the raising speed is too low, it takes time for the press base to be raised and the production efficiency is lowered, while if the raising speed is too high, volume expansion of the pressed bale cannot catch up with the raising speed for the press base, which leads to uncontrolled expansion of the pressed bale. The pressed bale of the present invention is volume-expanded in a controlled state under the pressure of the press base. As described above, the moving distance of the press base is 50 to 250 mm. The moving speed of the press base can be also set at approximately 20 mm/sec, for example, because the moving distance is small as above.

Moreover, a third solution is a process in which after packing is finished in a compressed state at a height lower than the desired bale height by 50 to 250 mm, the press base distance is adjusted to the desired height and then the pressure of the press base is released.

That is, in the present invention, a bottom-side film is set in advance on a lower press base (hereinafter, referred to as a lower base in some cases) of a compression box in the bale compressing device. Further, a top-side film is set in advance on an upper press base (hereinafter referred to as an upper base in some cases) of the compression box similarly to the bottom-side film.

Subsequently, a tow filament is fed into the normal compression box so as to form a bulky tow filament bale. Then, this bulky bale is compressed by the upper base and the lower base of the compression box so as to have a compressed-state bale (to be a pressed bale).

In a common technology, the height in the compressed state is a desired bale height, but in the present invention, compression is conducted to a height lower than the desired packed bale height by 50 to 250 mm (excessive compression). As described above, in a preferred mode of the present invention, the bale is held for 5 to 10 minutes in this state. Then, in packing of the pressed bale, by packing the pressed bale in this holding time, productivity can be improved. (The bale packing time can be reduced.)

In the present invention, packing in the excessive compression stage leads not only to the above improvement of productivity but also to the improvement of workability of the packing. That is, the packaging material of the bale has its lateral and longitudinal lengths determined according to the size of the desired bale. Therefore, if the pressed bale is to be packed in the bale compressed state by the method in the above-mentioned Patent Documents 3 and 5, there is no allowance in the packaging material. If the top-side film and the bottom-side film are to be bonded to the side-part film (film on the body part) in 3-piece packaging, for example, when the film of the body part is bonded with even slight distortion, the length of the packaging material runs short, which causes a problem that packing cannot be completed.

In order to avoid this, it is necessary to perform packaging with a packaging material of a size with allowance or to cut off the excess portion after the packaging material with a size with allowance is used. In the former case, there is a problem that the excess portion should be stored neatly because the film after the packaging is largely left as in the above-mentioned Patent Document 6. Further, as described above, a problem caused by abrasion of the excess portion occurs.

However, in the present invention, the height of the pressed bale has an allowance of 50 to 250 mm to the desired height of the packaged bale, and hence work can be conducted with at least the vertical direction of the body-part film sagged. Therefore, the problem is reduced.

Moreover, a fourth solution is to configure the packaging material for packaging the bale as two pieces. That is, the bottom-side film is formed into a bag in advance (into a bag-shaped film), and this bottom-side bag is set on the lower base of the compression box of the bale compressing device with the bag opened and folded. Further, the top-side film (lid material) is set in advance on the upper base of the compression box.

Subsequently, similarly to the above process of the present invention, the compressed state is brought about by compressing with the upper base and the lower base of the compression box (to obtain a pressed bale). However, the filter tow is fed into the bag so as to be in contact with the bag bottom face through the bag opening. Then, by pulling up the bag folded on the lower base of the compression box so as to cover the filter tow in the compressed state, the filter tow in the compressed state (pressed bale) is stored in the bottom-side bag.

Then, by sealing the bottom-side bag and the top-side film, which is set on the upper base, on four edges, airtight packaging with less excess capacity can be achieved easily by sealing only on four edges. If this process is used, bonding (heat seal, for example) is needed only on the four edges of the bottom-side bag and the top-side film, which simplifies the packing work of the bale. Further, a bonded portion with high reliability can be formed because the bonded portion other than the bottom-side bag and the top-side film portion can be bonded in advance.

In the above mode, in bag-making of the bag (bag-shaped film) to be set on the lower base, by making the dimension of the upper opening (bag opening) of the bag product larger than the dimension of the bottom face portion (bottom side) of the bag product, the work of pulling up the bag folded on the lower base so as to cover with that can be performed easily.

The lower size of the bottom-side bag is somewhat stretched by elasticity of the film, and hence it can have a size smaller than the bale dimension by 10 to 30 mm (approximately 1 to 3%), preferably approximately 10 to 20 mm.

The bag-shaped film preferably has a bag opening (opening) and a bottom face in the same shape, and if the bag opening and the bottom face both have a regular square shape, the upper size (length of one edge of the bag opening) to the lower size (length of one edge of the bottom face) is 105 to 120%, preferably 107 to 118%. More preferably, the size is 110 to 115%.

As the size by which the upper size is larger than the lower size, a length of 40 to 180 mm, more preferably a length of 60 to 160 mm, even more preferably a length of 80 to 140 mm is preferably ensured.

A bale weight of the present invention is preferably 400 kg or more and 1200 kg or less. Particularly preferably it is 500 kg or more and 1000 kg or less. If it is less than 400 kg, the packing weight is too low and load efficiency is lowered. If 1200 kg is exceeded, in order to obtain the packing density of approximately 700 kg/m$^3$, the size of the compressed bale becomes too large and the load efficiency is compromised. If the bale size is to be kept at approximately 1.6 m$^3$ with the bale weight of 1200 kg, the packing density becomes too high.

A preferred bale packing density in the present invention is the packing density of at least 300 kg/m$^3$ or more. More preferably it is 350 kg/m$^3$ or more and 1200 kg/m$^3$ or less, even more preferably it is 400 kg/m$^3$ or more and 1100 kg/m$^3$ or less, even more preferably 450 kg/m$^3$ or more and 1000 kg/m$^3$ or less, most preferably 500 kg/m$^3$ or more and 900 kg/m$^3$ or less. If the packing density is 350 kg/m$^3$ or more, the rebound pressure of a bale becomes large. The bale rebound pressure becomes further larger if the density exceeds 450 kg/m$^3$, and the present invention can be preferably applied. If the bale packing density is too high, it might damage the quality of the tow bale.

The compression pressure (pressing force) of 100 t/m$^2$ or more, preferably 200 to 500 t/m$^2$, more preferably 250 to 500 t/m$^2$ is applied on the pressed bale. The compressed bale is compressed by this high compression pressure and made into a pressed bale in the compressed state. If the compression pressure is small, a desired packing density cannot be obtained, while if the compression pressure is high, the quality of the bale tow might be damaged.

The packing density at the time of bale finishing of the present invention can be set in a range of from 500 to 1000 kg/m$^3$.

In the present invention, the negative pressure accompanying the expansion of the pressed bale described in the above-mentioned Patent Document 5 is not indispensable. However, a mode of the present invent ion may adopt a configuration in which, after rough packaging of the pressed bale with a packaging material, air inside of the package is removed from a non-sealed portion and a negative pressure is generated inside, and then full sealing is performed and the pressing force of the press base is released. In this case, a negative pressure is present inside the package of the pressed bale before release of the pressing force of the press base. After that, as in the present invention, the press base pressure is released.

When the press base pressure is released, if the degree of the above-mentioned excessive compression by 50 to 250 mm is small, the pressed bale is expanded by the internal pressure. In that case, if the negative pressure is generated inside the pressed bale, the expansion of the compressed bale is further controlled, which is preferred. However, the absolute value of the negative pressure inside the pressed bale is at most equal to the absolute value of an atmospheric pressure as described above, and the expansion controlling force of the pressed bale by the atmospheric pressure is at most the pressure generated by the atmospheric pressure, which is only 1.013 bar (101.3 kPa). The main action of controlling the expansion of the pressed bale is brought about by the excessive compression of the pressed bale in the present invention.

Further, an unavoidable excess portion of the packaging material caused by packing (packaging) of the pressed bale is attached firmly to the bale, which makes the excess portion indistinctive, and a stored state of the film excess portion is improved. Further, obstacles in loading or transportation of the bale caused by storage state of the film excess portion are solved. Moreover, a pin hole due to abrasion with the film excess portion is no longer generated. As described above, in the present invention, the bale package does not have to be fully sealed because presence of the negative pressure inside the bale is not a requirement. However, the bale is preferably sealed and packed because absorption of a smell or intrusion of an insect into the bale is a big problem in quality of the filter tow bale.

Further, a negative pressure to be given to the pressed bale is preferably at least 3 kPa (0.03 bar) or more, more preferably 4 kPa (0.04 bar) or more and 9 kPa (0.09 bar) or less, even more preferably 5 kPa (0.05 bar) or more and 8 kPa (0.08 bar) or less, even more preferably 5 kPa (0.05 bar) or more and 7 kPa (0.07 bar) or less. If it is less than 4 kPa, a force to bring the film excess portion into close contact with the bale is too small. Further, if it is equal to or more than 9 kPa, it takes a long time to deaerate.

The bale packed by the packing method for the filter tow bale of the present invention experiences no or extremely small expansion caused by the rebound pressure of the pressed bale upon release of the pressure. Thus, a stress applied to the packaging material of the bale is small. As a result, a problem such as rupture of the bale package hardly occurs.

Further, the workability in packing of the bale is kept favorable while the completed bale has no excess portion in the package, to thereby obtain a bale with a satisfactory appearance.

DETAILED DESCRIPTION OF THE INVENTION

Figure 1:
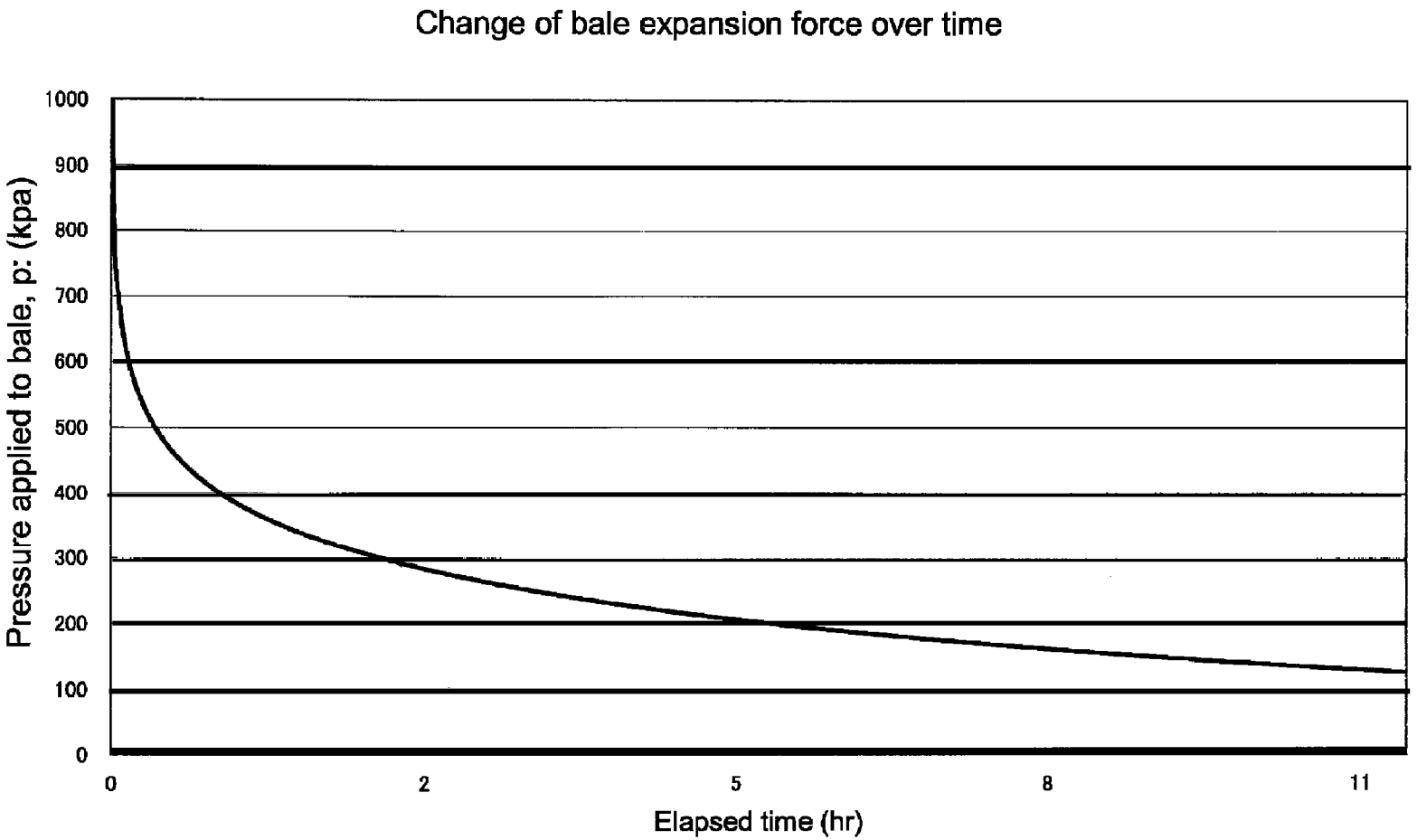
FIG. 1 is a graph illustrating damping of a rebound force of a bale in Experiment 1.
Figure 2A:
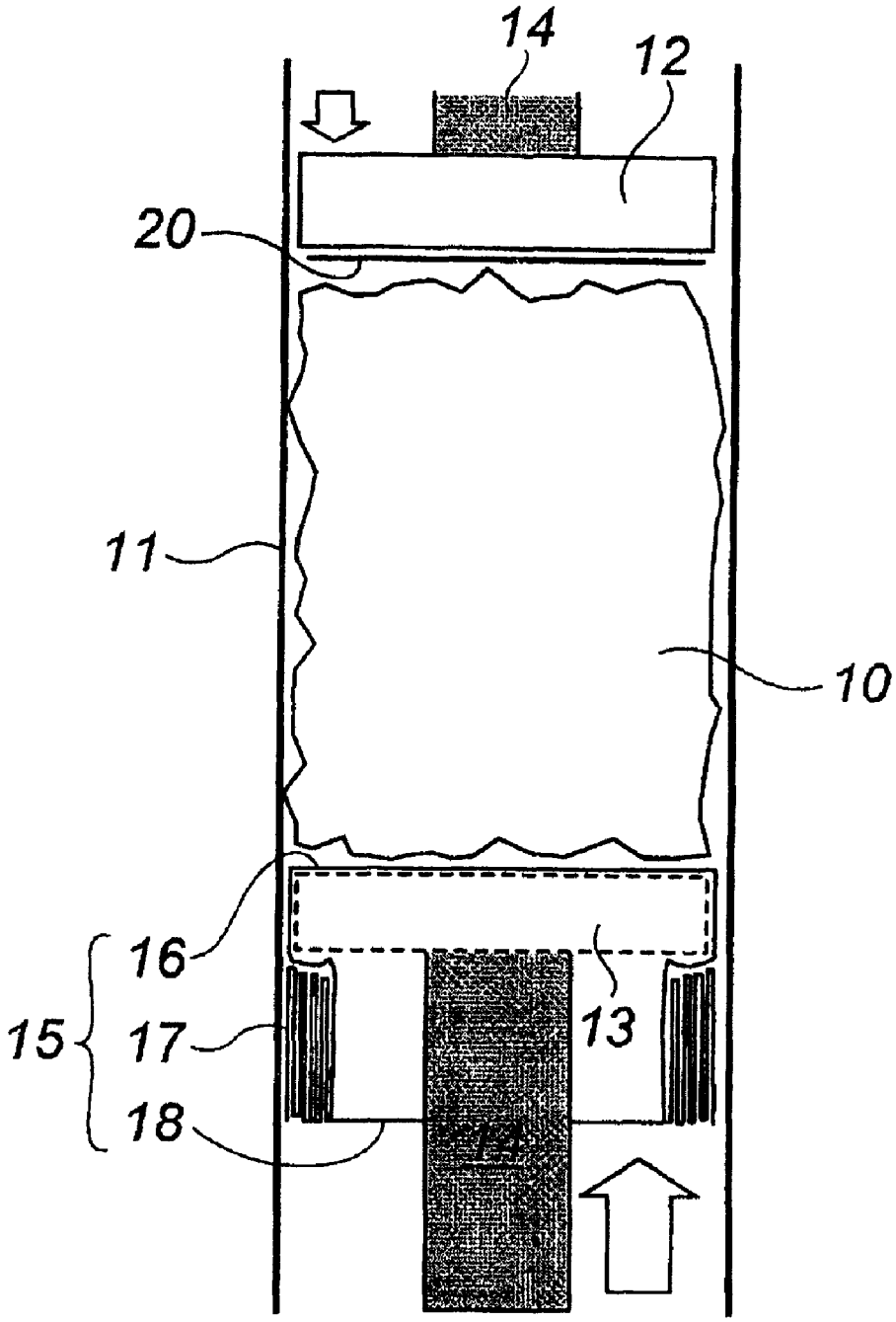
FIGS. 2(*a*)-(*d*) are sectional views of a bale packing device used in the present invention.
Figure 2B:
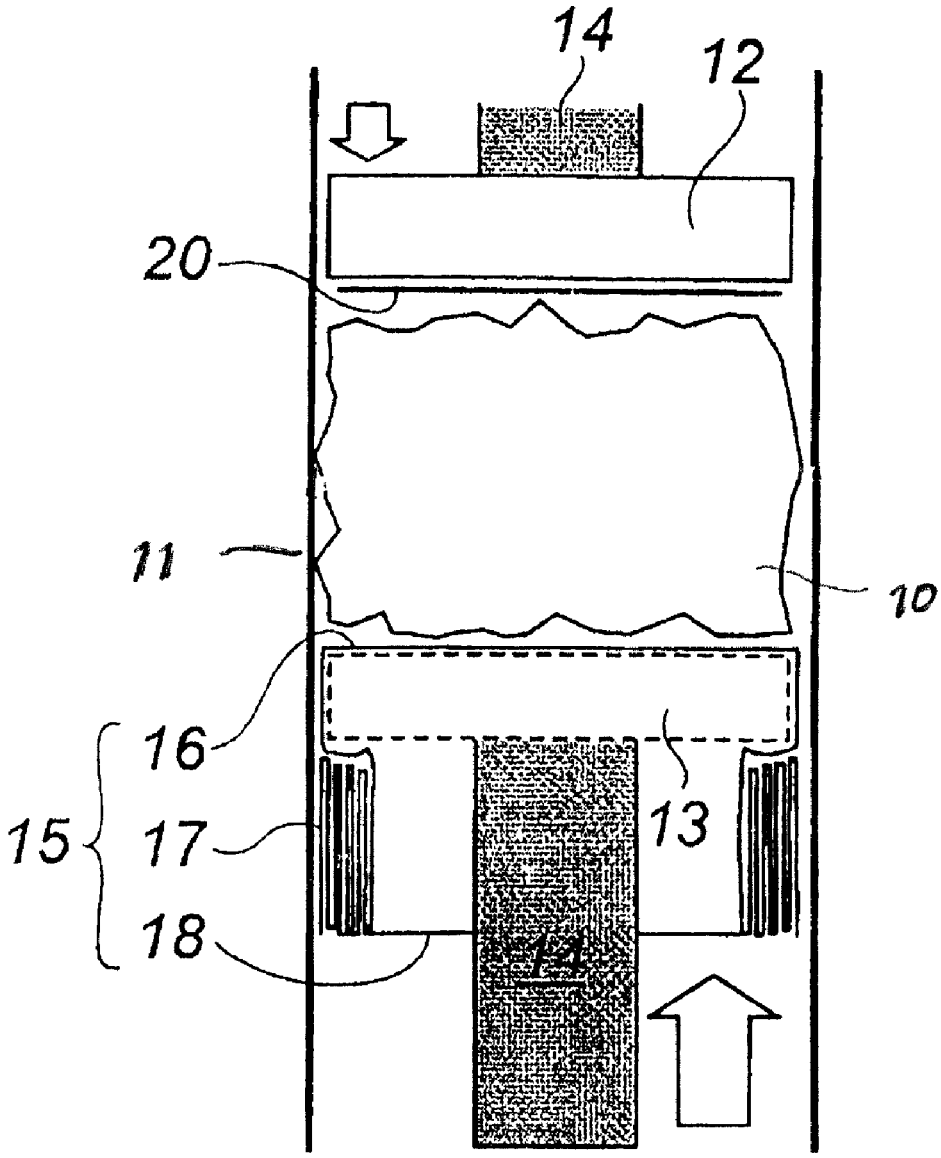
Figure 2C:
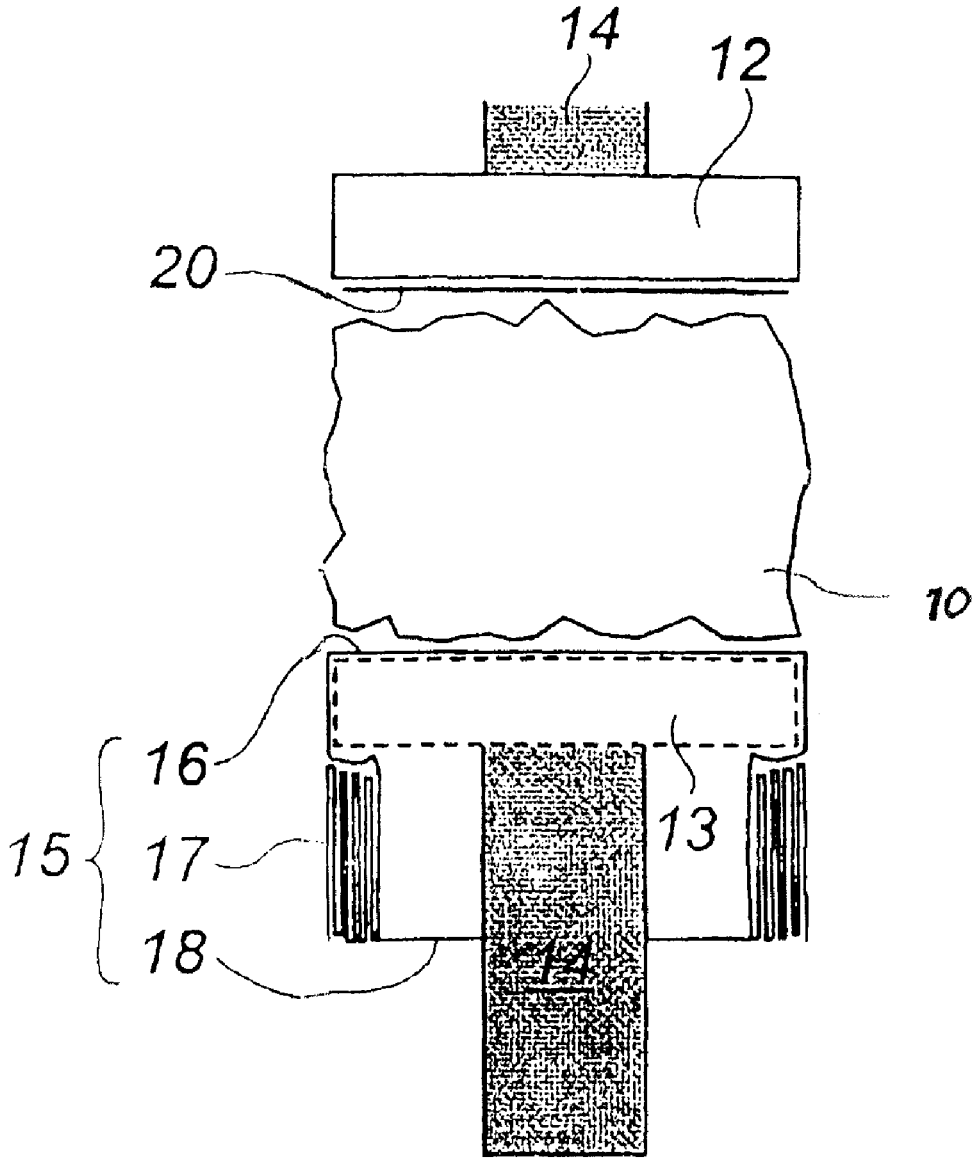
Figure 2D:
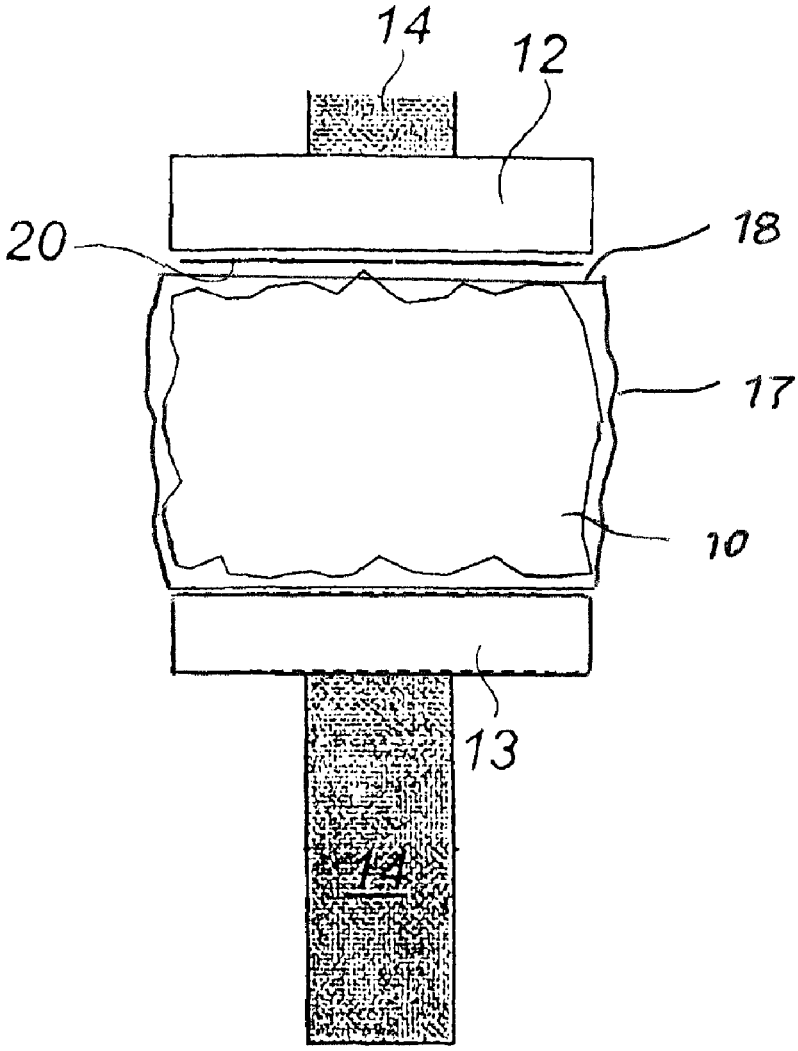

In the figures, the symbol 10 represents filter tow, the symbol 11 represents a filling container (compression box), the symbol 12 represents an upper press base, the symbol 13 represents a lower press base, and the symbol 14 represents a hydraulic rod, respectively.

(Packing Device)

As described above, as a device for packing filter tow bale of the present invention, a usual packing device for the filter tow bale can be used. This type of packaging method and packaging device are described in WO-A2 02/32238 as a bale compressing device (bale packing device). This type of device creates a pressed bale by compressing the filter tow integrated in a filling container by upper and lower press bases and packs the pressed bale. FIG. 2 shows a sectional view of an example of the packing device.

(Film)

In the present invention, a packaging material of a bale is not particularly limited as long as it has extensibility and strength to withstand the remaining rebound force of the bale. A preferred packaging material is a film or a sheet. The terms of film and sheet are not clearly distinguished in general, but a plate state one made of a synthetic resin of approximately 300 μm or less is referred to as a film, while the one exceeding 300 μM is referred to as a sheet in many cases.

In the present invention, either of a film or a sheet can be used, but it will be referred to as a film in relation with the thickness to be preferably used in the present invention, which will be described later.

As the film, a film made of a synthetic plastic is preferred. A so-called general-purpose plastic film can be preferably used. A plastic film as a general packaging material includes an oriented film and a non-oriented film, but a non-oriented film can be preferably used because a problem of shrinking hardly occurs if the bonded portion (seal portion) of the film is formed by heat sealing.

Further, the plastic film includes single layer and multilayer films. Although a single layer film can be used, a multilayer film can be preferably used. A preferred sheet material is made of a multilayer film, and at least the outermost layer is preferably polyolefin or particularly preferably polyethylene (PE). In polyethylene, low-density polyethylene (LD) is preferred. LLDPE (linear low density polyethylene) is more preferred. The total thickness of these films may be 150 to 350 preferably 200 to 270 μm.

These film layer may be formed of four layers or more or a layer having a barrier function. It is preferably a multilayered film having two layers or three layers. A layered structure of LLDPE/EVA/LLDPE or PE/EVA/PE having ethylene-vinyl acetate copolymer (EVA) as a central layer is particularly preferred and a layered structure of PE/PA/PE having polyamide (PA) as a central layer is also preferred. The layered structure is preferably symmetric to the center layer sandwiched.

In the case of the structure of LLDPE/EVA/LLDPE, the thickness of each layer may be LLDPE/EVA/LLDPE=80 to 100/30 to 70/80 to 100 (μm). With regard to printing, direct contact of the printing ink with the tow bale can be avoided by performing printing on an LLDPE film and determining the printed surface as a surface to be laminated.

As a manufacturing method for the PE/EVA/PE film, it can be manufactured by extrusion laminating the EVA between two films with a thickness of 80 to 100 μm.

The film of PE/PA/PE can be manufactured by dry laminating a PE film with a PA film. The PA film may be an oriented film. Three or more-layered film using an oriented PA film is suitable for a bag-making work because hardness of the film can be maintained appropriately.

So-called oxygen gas barrier is not required in the present invention as described above, but in order to prevent absorption of an outside smell to the filter tow material, a multilayer film having a resin such as nylon or EVOH as a composition layer may be used.

(Top-Side Film)

In the present invention, the top-side packaging material does not particularly need to be molded, but the film may be molded. It is preferably a mere single film. Therefore, a shape and size thereof do not matter as long as a compression surface of an upper compression base in a bale packing machine can be covered. However, from the viewpoint that the excess packaging material is intended not to be generated in the bale after packing, the material is preferably cut and used in a shape of a square with a size of the upper size of the bottom-side bag added with a margin for a seal portion. A dimension of the sealing margin is approximately 20 to 100 mm, preferably 30 to 80 mm.

(Setting of the Top-Side Film in the Bale Packing Machine)

It is only necessary that the top-side film is fixed to the compression surface of the upper base of the bale packaging device with double-sided tape or adhesive tape-like substances. Alternatively, a part of the film may be folded into a side face of the upper base and then, the side face of the upper base may be tightened by a shrink strap such as a rubber tube for fixation. In any case, it is only necessary that the top-side film is set on the compression surface brought in contact with the filter tow on the upper base of the bale packing machine.

(Bottom-Side Film)

Those similar to the top-side film can be used. Further, setting of the bottom-side film in the bale packaging machine can be performed similarly to the top-side film. In any case, it is only necessary that the bottom-side film and the top-side film are set on the surface brought in contact with an assembly of the filter tow.

(Side Part Film)

A film with the same material as that of the top-side film or bottom-side film can be used as a film for packaging a body part of the pressed bale. The side part film may be a film which may be capable of wrapping around the body part of the pressed bale with a continuous film or may be constituted by four films, that is, side face parts, front face, and back face. In the case where the side part film is constituted by four films, the four films are also bonded by film bonding, which will be described later.

(Bale Packing Method)

A packing method for a filter tow bale using a packing device shown in FIG. 2 will be described.

<Step (a)>

As described above, a bottom-side film (or a bottom-side bag) 15 is set on a lower base 13 of a bale packing machine. Further, a top-side film 20 is set on a compression surface of an upper base 12 of the bale packing machine. The upper and lower bases 12 and 13 move in a compression box 11 of the bale packing machine, and a non-compressed filter tow 10 is fed between the upper base 12 and the lower base 13.

<Step (b)>

Subsequently, the upper base 12 and the lower base 13 are moved so as to narrow a distance therebetween and to compress the filter tow 10.

In the present invention, compression is performed between the upper base 12 and the lower base 13 with a pressure of 100 t/m$^2$ or more, and the distance between the press bases 12 and 13 is adjusted to a distance smaller than a desired finished bale height by 50 to 250 mm so that the filter tow 10 is excessively compressed. If the desired bale height is 1000 mm, for example, the distance between the bases is set at 900 mm. In this state, the filter tow 10 in the bale packing machine becomes a pressed bale.

In a preferred mode of the present invention, the pressed bale is held for 5 to 10 minutes in this compressed state. During that period, the pressed bale is packaged by a body part film (or the bottom-side bag if the bottom-side bag is used). After that, the pressure applied to the press bases 12 and 13 is released (hereinafter referred as "release of the compressed bale" in some cases).

<Step (c)>

After the pressed bale is packaged by a film, it is sealed. Bonding (sealing) of the package of the pressed bale (compressed filter tow 10) in Step (c) is not particularly limited. It may be heat sealing or ultrasonic sealing. That is, it is only necessary that adhesion strength in a degree that can withstand the weak rebound pressure of the pressed bale of the present invention is provided. The bonding may be made by an adhesive. Among them, heat sealing is preferred. The heat sealing may be linear sealing or spot sealing.

Further, the seal surface may be a seal surface in which a groove in the seal width direction (longitudinal direction) is formed or a so-called grid seal surface. The seal width may be set as appropriate in a range of 3 to 15 mm, but the seal width of 5 to 10 mm is preferred. If the seal width is large, it becomes difficult to manually peel off the seal portion in unpacking, and hence unpacking performance is poor. Therefore, preferably by extending a seal with a narrow width over the entire circumference, absorption of outside smell can be prevented. On the contrary, if the seal portion width is too small, a defect might occur in the seal portion.

<Step (d)>

While compression by the upper base 12 and the lower base 13 is maintained, the distance between the upper base 12 and the lower base 13 is increased in a range of 50 to 250 mm so as to expand the pressed bale (compressed filter tow 10).

The moving distance of the press bases 12 and 13 (the distance between the upper base 12 and the lower base 13 described above), that is, the excessive compression distance is preferably 50 to 250 mm as described above, more preferably 80 to 200 mm, even more preferably 90 to 180 mm, even more preferably 90 to 150 mm.

<Step (e)>

After sealing, the compression pressure applied onto the pressed bale (compressed filter tow 10) is released. By applying the packing method having the above steps (a) to (e), no expansion by the rebound pressure of the pressed bale at release of the pressed bale is caused or the expansion can be controlled.

(2-Piece Packaging)

In the present invention, the packaging material for packaging the pressed bale may be constituted by two portions, that is, a top-side film and a bottom-side bag. This form of packaging is hereinafter referred to as "2-piece packaging". In the 2-piece packaging, the bottom-side bag to be set on the lower base may be molded in advance into a shape of a bag (bag-shaped film 15 of FIG. 2). Then, the molded bottom-side bag is set on the lower base (can be the upper base depending on the case) of the bale packing device in a folded state with a bag opening opened. If this bag-shaped film 15 is used, in Step (a), the bag-shaped film 15 covers the lower base 13 so that a bottom face 16 side is on the lower base 13 of the bale packing machine, and a folded side face 17 and a bag opening 18 are on a back side (side opposite the filter tow 10) of the lower base 13. At this time, a hydraulic rod 14 is surrounded on the back face side of the bag 15. Then, filter tow 10 is placed in contact with the bottom face 16.

In a stage where the pressed bale is produced (Step (b)), the bottom-side bag drawn out from the lower base 13 (or the upper base 12) is pulled up (or pulled down) so as to cover the compressed bale. In order to cover the compressed tow bale with the bottom-side bag, the bottom side-bag may be in a deformed rectangular solid.

That is, if the face covered with the top-side film represents an upper face, the bag may be in a shape of a deformed rectangular solid with the upper face opened. That is, a side face projection view in a state in which the bottom-side bag is raised to a cubic shape forms a shape widened toward the upper face. Using such shape, a work to cover the pressed bale with the bottom-side bag is facilitated.

In order to form this shape, the size of the bottom-side bag is important. That is, the upper part size of the bottom-side bag needs to be larger than the lower part size. As described above, by making the upper part size larger than the lower part size, the bag drawn out from the lower base can be easily made to cover the bale in a compressed state as described above. The ratio of the upper part size to the lower part size is 105 to 120%, preferably 107 to 118%, more preferably 110 to 115%.

As the size of the upper part size larger than the lower part size, a length of 40 to 180 mm is ensured, preferably a length of 60 to 160 mm, more preferably a length of 80 to 140 mm. That is, the upper part size larger than the lower part size becomes an excess portion when the compressed bale is covered with the packaging material, the four edges are sealed by heat sealing, and the compression force of the bale is released. At the same time, the excess portion becomes a cutting margin when the bale is unpacked.

Therefore, if the upper part size is 40 mm or more, a sufficient cutting margin can be ensured, and packing performance and unpacking performance are both improved, but when the film is to be cut off, there is a possibility to contact with the contents of the bale. The contents of the bale are continuous filament tow. Therefore, if a cutter is brought into contact in unpacking, the continuous fiber might be ruptured, which causes a trouble in a winding-up process of a filter rod. On the other hand, if it is 180 mm or less, the excess portion after being packed by the packaging material is small, which is preferred.

The bottom-side bag can be easily manufactured by sealing two films. That is, two films to be the packaging material are overlapped with each other and then, three edges are cut to a dimension obtained by adding up a dimension of the width and the length of the upper part size added together and a dimension of the width and the length of the lower part size added together and then sealed. After that, an opening of an unsealed edge is opened and folded to be a predetermined height. The bag is raised in the shape of a rectangular solid (or more accurately, a deformed hexagonal body whose upper part size and lower part size are different from each other). By raising the bag, a folded portion (ship bottom portion) is generated in a side face part of the bottom edge. By further sealing the ship bottom portion generated by the folding so that the bottom edge of the side face is formed, the folded portion forms a square bottom of the rectangular solid.

Figure 3:
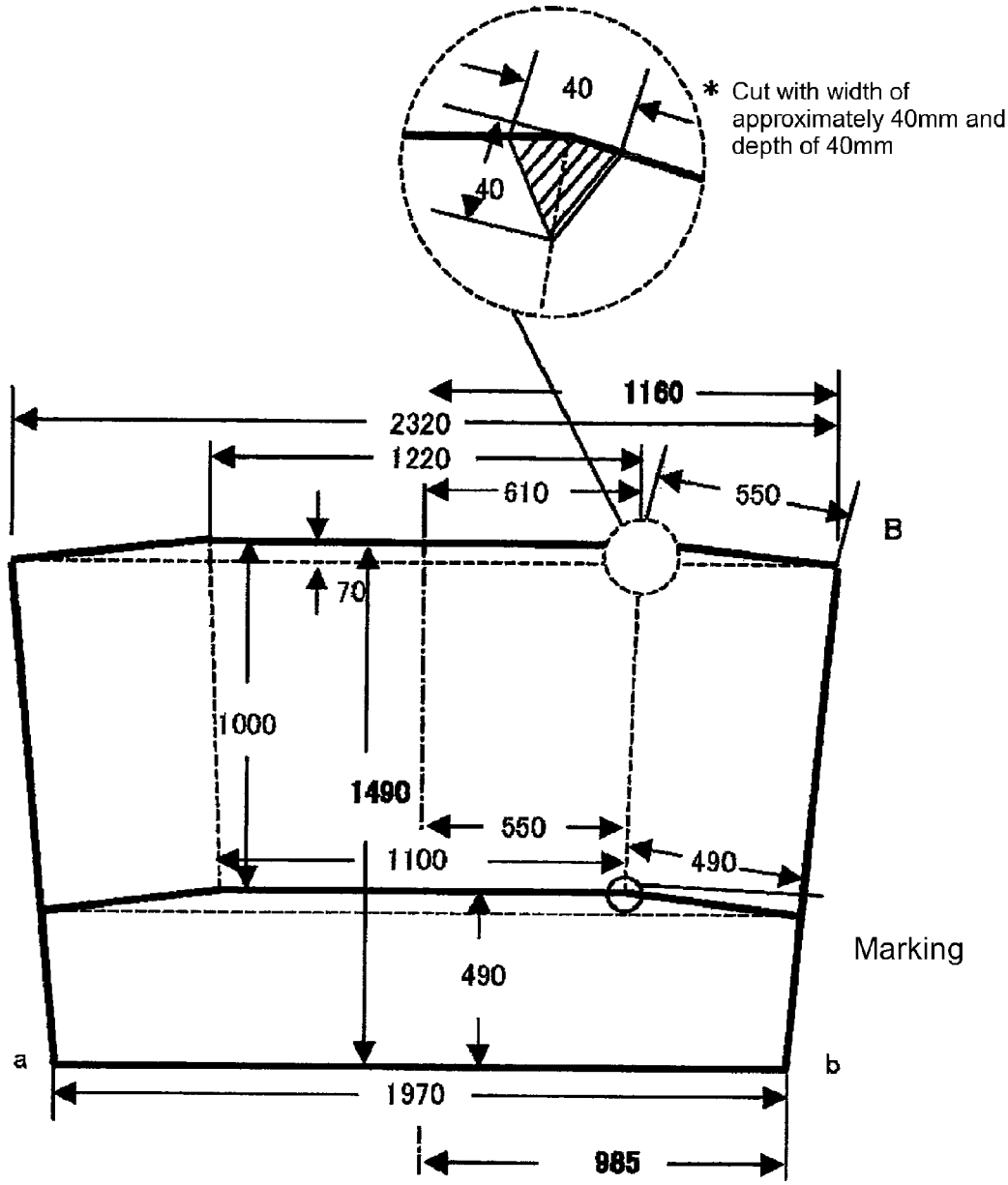
FIG. 3 is a diagram of a bottom bag.

In the case of this bag product, the seal portion is generated at the center part (center line) on the side face and the bottom face, and moreover, the seal portion is also generated at the bonded portion between the side face and the bottom face, which forms a deformed three-side seal bag. In the folded state, it makes a bag with a gusset generated on the side face. An example of a bag product sealed on three sides is shown in FIG. 3.

In the bottom-side bag, it is effective to cut off a corner top portion of an apex formed by the front face and the side face, and the rear face and the side face in a triangle with a size of approximately 20 to 40 mm. In this manner, when the bottom-side bag is placed over the compressed bale and sealed with the top-side sheet, sealing between the bottom-side bag and the top-side sheet is facilitated. A cut-off portion is shown in a circle of FIG. 3. If the cut-off portion is not formed, when the upper opening of the bottom-side bag is sealed with the top-side sheet, crimps can be easily created in the bottom-side bag, which might cause seal leakage.

EXAMPLES

The present invention will be described below in more detail on the basis of a preferred embodiment with reference to the attached drawings.

Example 1

Referring to FIGS. 2(*a*)-(*d*), description will be made thereon. Reference numerals of FIG. 2 are described with parentheses.

<Step (a)>

As a packaging material for packing the bale, a multilayer film (with the thickness of 250 μm) of LDPE/EVA/LDPE obtained by extrusion laminating an LDPE film of #100 sold in the market (with the thickness of 100 μm) with EVA and bonding them was used.

Subsequently, in the filling container (filling box) (11) as described in WO-A2 02/32238, a manufactured filter tow (10) was fed as the continuous fiber, as shown in FIG. 2(*a*). The size of the filling container (11) was 1130 mm in width and 990 mm in depth. The filter tow (10) in the filling container (11) is extremely bulky and the height was 4000 mm. The bottom-side bag (bag-shaped film) (15) was set so that the bottom face (16) was on the lower base (13) of the bale packing machine, the folded side face (17) and the bag opening (18) were on the back side of the lower base (13), and the hydraulic rod (14) was surrounded. Moreover, the top-side film was set on the upper base (12).

<Step (b)>

In this example, the desired bale height was set at 1000 mm. The excess compression was set at 100 mm. Then, the filter tow (10) fed into the filling container (11) was pressurized and compressed by the upper and lower bases (12), (13) with a pressure of 283 ton/bale sectional area (that is, 2940 kPa) so that the distance between the upper and lower bases (12), (13) becomes 900 mm. In this state, the pressing force was kept for 10 minutes.

In the state in which the pressed bale (compressed filter tow (10)) was sandwiched by the upper and lower bases (12), (13) and while the distance between the upper and lower bases (12), (13) was kept at 900 mm, which is the compressed bale height, the compression container was removed. The pressed bale was sandwiched between the upper and lower bases (12), (13) and the side face of the pressed bale was exposed. After that, the side face (17) of the bag (15) set on the lower base (13) was pulled up and placed over the pressed bale.

<Step (c)>

Subsequently, using a film with the width of 980 mm, the body part of the pressed bale is wrapped around one turn. The side part film (body part film), the top-side film, and the bag (15) were heat-sealed by a heat sealing device with a width of 10 mm, respectively, over the entire circumference. Lastly, end portions of the body part were heat-sealed by heat sealing device with a width of 10 mm over the entire width.

<Step (d)>

After that, the upper press base (12) was moved for 100 mm at the moving speed of 20 mm/sec to have the pressed bale height of 1000 mm. The pressed bale was expanded following the moving speed of the upper press base (12).

<Step (e)>

From this state, the upper press base (12) was moved for 300 mm at the moving speed of 70 mm/sec, and the pressure of the upper and lower bases (12), (13) were fully released, but the pressed bale was no longer expanded, and a filter tow bale having a smooth upper face was manufactured. 100 such bales (packages) were manufactured, and raptures thereof and the like were examined. The rupture was determined by presence of a change in the bale height after 72 hours after the bale packaging, and the bale whose bale height has been changed was determined as a ruptured bale. The result is described in Table 1.

Example 2

The filter tow bale having the same packaging material, the same width, length, and height as Example 1 was produced. The excessive compression distance was set to 100 mm similarly to Example 1. However, with the holding time in the excessive compressed state at zero, the bale was held with the height of 1000 mm for 10 minutes. In this embodiment, after the release of the pressed bale, the pressed bale was slightly expanded in approximately one second and then stood still. The height of the expanded bale was 1005 mm. Similarly to Example 1, 100 bales were manufactured in this method, and the ruptures thereof and the like were examined. The result is described in Table 1.

Example 3

The filter tow bale with the same packaging material and dimension as in Example 1 was manufactured. However, the excessive compression distance was set at 50 mm. Therefore, the distance between the press bases was 950 mm. The excessive compression time was set at 15 minutes.

In this embodiment, as auxiliary means, after the side part film (body part film), the top-side film, and the bag were bonded by the heat sealing device with the width of 10 mm, respectively, the end portions of the body part were heat-sealed by the heat sealing device with the width of 10 mm over the entire width leaving a portion not heat-sealed for 70 mm at the center part. A hose was inputted through the 70 mm portion without heat seal so as to exhaust air inside the pressed bale. A barometer (manufactured by Sunoh Co., Ltd., model: SAL7030) was fed in the pressed bale. A numeral value on the barometer was checked through the package film because the package film is transparent. After exhaustion of air was finished, the 70 mm portion without heat seal was heat-sealed and the pressed bale was sealed.

The pressure inside the pressed bale in sealing was 983 hPa (0.983 bar) and thus, the negative pressure was 0.03 bar. After the excessive compression process was finished, the upper press base was moved for 50 mm at the moving speed of 20 mm/sec so as to have the pressed bale height of 1000 mm similarly to Example 1.

After that, the upper press base was moved for 300 mm at the moving speed of 70 mm/sec so as to release the press base pressure similarly to Example 1. In this embodiment, at the release of the press base, the pressed bale was expanded in approximately one second and then stood still. The expanded bale height reached 1020 mm, the pressure inside the bale was 963 hPa (0.963 bar), and the negative pressure was 0.05 bar, but because an expansion amount of the bale was small, the bale was not ruptured and the upper part of the bale was smooth. Further, the packaging material was in close contact with the bale, and a tow bale with satisfactory appearance was formed. Similarly to Example 1, 100 bales were manufactured in this method, and the ruptures thereof and the like were examined. The result is described in Table 1.

Example 4

Similarly to Example 3, the inside of the pressed bale was deaerated. That is, the filter tow bale with the same packaging material and dimension as those of Example 1 was manufactured. The excessive compression distance was 100 mm, and the excessive compression time was 15 minutes. The pressure inside the pressed bale in sealing of the pressed bale was 983 hPa (0.983 bar), and the negative pressure was 0.03 bar. After the excessive compression process was finished, the upper press base was moved for 100 mm at the moving speed of 20 mm/sec similarly to Example 1 so as to have the compressed bale height of 1000 mm.

After that, the upper press base was moved for 300 mm at the moving peed of 70 mm/sec similarly to Example 1, and the press base pressure was released. In this embodiment, the bale was not expanded similarly to Example 1, the packing material was in close contact with the bale, and a tow bale with satisfactory appearance was formed. The pressure inside the pressed bale after the release of the pressed bale was 983 hPa (0.983 bar), and the negative pressure was 0.03 bar. Similarly to Example 1, 100 bales were manufactured in this method, and the ruptures thereof and the like were examined. The result is described in Table 1.

Comparative Example 1

The sealing packaging described in the above-mentioned Patent Document 3 was performed without using the excessive compression of the present invention. That is, using the filter tow similar to that of Example 1, filter tow bale with the same packaging material, the same width, length, and height was manufactured. However, in this comparative example, excessive compression was not performed.

That is, the desired bale height was set at 1000 mm. The filter tow fed in the filling container was pressurized and compressed by the upper and lower bases with a pressure of 283 ton/bale sectional area (that is, 2940 kPa) so that the distance between the bases becomes 1000 mm. In this state, the pressing force was kept for 10 minutes.

In the state in which the pressed bale was sandwiched by the upper and lower bases and while the distance between the upper and lower bases was kept at 1000 mm, which is the pressed bale height, the pressed bale was discharged from the lower part of the compression container. The press base was sandwiched by the upper and lower bases, and the side face of the pressed bale was exposed.

After that, the top-side film and the bottom-side film having been set on the upper and lower bases were drawn out. Then, using a film with the width of 980 mm, the body part of the pressed bale was wrapped around one turn. The side part film (body part film), the top-side film, and the bottom-side film were heat-sealed by the heat sealing device with the width of 10 mm, respectively, over the entire circumference. Lastly, the end portions of the body part were heat-sealed by the heat sealing device with the width of 10 mm over the entire width.

After that, the upper press base was moved for 300 mm at the moving speed of 70 mm/sec, and the press base pressure was released. The pressed bale was expanded by 100 mm in 1.4 seconds after the pressure release and then, the expansion of the bale was stopped. The bale height reached 1100 mm, and this bale became a ruptured bale in the end.

100 such bales (packages)) were manufactured, and the rupture state was examined similarly to the above. The result is described in Table 1.

Comparative Example 2

Similarly to Example 4, the inside of the pressed bale was deaerated. That is, the filter tow bale with the same packaging material and dimension as those of Example 1 was manufactured. The distance between the press bases was set at 1000 mm because the excessive compression was not performed similarly to Comparative Example 1. Then, similarly to Example 3, after the side part film (body part film), the top-side film, and the bottom-side film were bonded by the heat sealing device with the width of 10 mm, respectively, the end portions of the body part were heat-sealed by the heat sealing device with the width of 10 mm over the entire width leaving a portion not heat-sealed for 70 mm at the center part. A hose was inputted through the 70 mm portion without heat seal so as to exhaust air inside the compressed bale. After the deaeration was finished, the 70 mm portion without heat seal was heat-sealed and the pressed bale was sealed.

The negative pressure inside the pressed bale was similar to Examples 3 and 4. The pressure inside the pressed bale in sealing was 983 hPa (0.983 bar) and the negative pressure was 0.03 bar. From this state, the upper press base was moved for 300 mm at the moving speed of 70 mm/sec, and the press base pressure was released. In this embodiment, the pressed bale was expanded in 1.4 seconds at the release of the press base, and then stood still. The expanded bale height reached 1100 mm, the pressure inside the pressed bale was 883 hPa (0.883 bar), and the negative pressure was 0.10 bar at maximum. However, the negative pressure was damped with elapsing of time because the bale was ruptured, and the pressure in the bale became the atmospheric pressure in the end. 100 such bales were manufactured similarly to Comparative Example 1, and the rupture state was examined similarly to the above.

TABLE 1

| | Rupture rate (%) |
|---|---|
| Example 1 | 1 |
| Example 2 | 2 |
| Example 3 | 1 |
| Example 4 | 0 |
| Comparative Example 1 | 41 |
| Comparative Example 2 | 23 |

As is apparent from Table 1, the bales subjected to the excessive compression of the present invention have less rupture. That is, the bale height change of ter the bale packaging is smaller. In the pressed bale deaerated as in Comparative Example 2, the rupture rate is smaller than that of Comparative Example 1, but it is still not sufficient. The filter tow bale is, as described above, a product to be exported abroad in a high ratio, and in the case of such export, a transport container of the international standard is used. If there should be only one bale whose bale height is changed in the container, it becomes difficult to carry the bale out of the container, which lowers unloading work efficiency. On the other hand, by using the bale subjected to the excessive compression of the present invention, rupture of the bale is controlled, and the bale height is not changed. Therefore, stable transportation can be realized.

Rupture rate of the bale in Examples and Comparative Examples (Measurement of Rebound Pressure of the Pressed Bale)

In the following examples, a rebound pressure of the pressed bale was measured in order to verify the effect of the present invention. The measurement method was performed as follows.

[Experiment 1]

A tow bale (weight: 500 kg) made up of 10,000 pieces of 3-denier filament was compressed by a compression force of 303 ton into a size of length 1 M×width 0.75 M and height of 0.98 M so as to make a pressed bale. The compression pressure was decreased so that the movement of the upper base after the compression is maintained so that the distance between the bases is 980 mm using an ultrasonic sensor. The press top plate was to move upward by the rebound force of the tow bale with decrease of the pressing force, but if it started to move, digital signal control was performed according to a signal from the ultrasonic sensor so as to increase the pressing force, and if the distance between the bales was smaller than 980 mm because the pressing force was too high, to the contrary, the pressing force was decreased. The control was made by PID control generally used in the industry, and a substantial stand-still state was maintained.

As described above, only the pressing force corresponding to the bale expansion force was applied, and in a state in which the upper press base was rarely moved, a change in elapsed time of the pressure required to maintain the compressed bale height constant was observed. Data sampling time was at 10 second intervals. A damping behavior in 11 hours is shown in FIG. 1. Further, the damping behavior in 30 minutes is shown in FIG. 4.

[Experiment 2]

Subsequently, in order to verify the effect of the excessive compression of the present invention, the rebound force in the case of the excessive compression was measured. That is, the pressed bale similar to Experiment 1 was manufactured and the distance between the bases was held at 980 mm for 10 minutes and then, the upper press base was moved for 100 mm at the moving speed of 20 mm/sec to have the pressed bale height of 1080 mm. That is, it can be considered that the excessive compression of 100 mm and 10 minutes was performed. After the upper press base is stopped, the rebound pressure of the pressed bale was further measured similarly to Experiment 1. Data of the moving time (5 seconds) of the upper press base cannot be sampled (because a hydraulic pressure is used for moving the upper press base). The result is shown by a broken line of FIG. 1.

Figure 4:
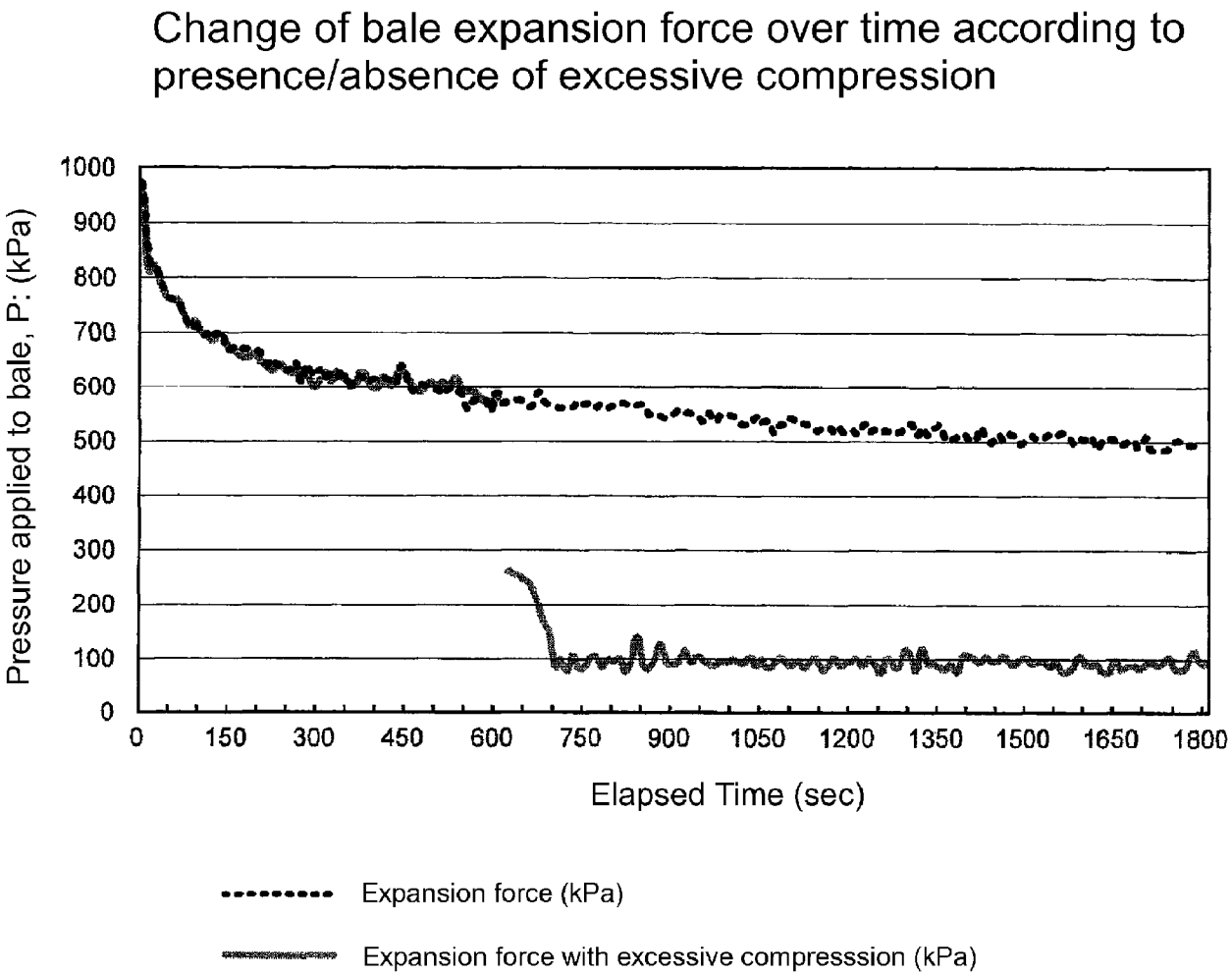
FIG. 4 is a graph illustrating damping of the rebound force of the bale in 30 minutes in Experiment 1 and Experiment 2.

As is apparent from FIG. 4, if the excessive compression of the present invention is performed, the rebound pressure of the pressed bale can be drastically decreased. As a result, a stress applied to the packaging material of the pressed bale can be naturally alleviated. Then, rupture of the bale package can be avoided because there is no or extremely small expansion of the pressed bale.

The invention claimed is:

1. A packing method for a filter tow bale in which filter tow is compressed and packed with a compressing device including an upper press base and a lower press base to manufacture the filter tow bale, comprising steps of:

(a) setting a top-side film on a compression surface of the upper press base, setting a bottom-side film on a compression surface of the lower press base, and feeding the filter tow between the compression surface of the upper press base and the compression surface of the lower press base;

(b) compressing the filter tow with a pressure of 100 t/m$^2$ or more by said upper press base and said lower press base, by making the distance between said upper press base and said lower press base smaller than a desired height of the finished bale by 50 to 250 mm, so as to form a pressed bale having the packing density of 450 to 1200 kg/m$^3$;

(c) packaging the pressed bale with the top-side film and the bottom-side film and then sealing the top-side film and the bottom-side film to each other in an airtight state;

(d) increasing a distance between said upper press base and said lower press base of the steps (b) and (c) by a range of 50 to 250 mm at the moving speed of 10 to 50 mm/sec so as to expand the pressed bale; and (e) releasing the compression pressure applied on the pressed bale after the sealing.

2. The packing method for a filter tow bale according to claim 1, wherein the step (b) is a step of applying and maintaining the pressure of 100 t/m$^2$ or more for 5 to 15 minutes.

3. The packing method for a filter tow bale according to claim 1, wherein the step (c) is a step of sealing the pressed bale with the top-side film and the bottom-side film in the airtight state under a state of applying and maintaining the pressure of 100 t/m$^2$ or more for 5 to 15 minutes in the step (b).

4. The packing method for a filter tow bale according to any one of claims 1 to 3, wherein the step (a) is a step of setting the top-side film on the compression surface of the upper press base, setting a bag-shaped film that is opened and folded on the compression surface of the lower press base, and then feeding the filter tow between the compression surface of the upper press base and the compression surface of the lower press base.

5. The packing method for a filter tow bale according to claim 4, wherein the step (c) includes the step of drawing out the folded bottom-side film to cover the pressed bale.

6. The packing method for a filter tow bale according to claim 1, wherein the step (c) is a step of packaging the pressed bale with the top-side film, the bottom-side film and a body part film and then sealing the top-side film, the bottom side film and the body part film to each other in an airtight state under a state of applying and maintaining the pressure of 100 t/m$^2$ or more for 5 to 15 minutes in the step (b), by making the distance between said upper press base and said lower press base smaller than a desired height of the finished bale by 50 to 250 mm.

7. The packing method for a filter tow bale according to any one of claims 1 to 3, wherein the step (a) is a step of setting the top-side film on the compression surface of the upper press base, setting a bag-shaped film in a state of being opened and folded on the compression surface of the lower press base, and then feeding the filter tow between the compression surface of the upper press base and the compression surface of the lower press base.

8. The packing method for a filter tow bale according to claim 7, wherein the step (c) includes the step of drawing out the folded bottom-side film to cover the pressed bale.

* * * * *